United States Patent [19]

Ichihara et al.

[11] Patent Number: 4,709,667

[45] Date of Patent: Dec. 1, 1987

[54] OIL SUPPLY DEVICE FOR VALVE OPERATING SYSTEM HAVING HYDRAULIC TAPPET IN INTERNAL COMBUSTION ENGINE

[75] Inventors: Eiichi Ichihara, Shakujii; Itsuo Iwai, Shinminato, both of Japan

[73] Assignees: Honda Giken Kogyo Kabushiki Kaisha, Tokyo; Tanaka Machine Industries Co., Ltd., Toyama, both of Japan

[21] Appl. No.: 862,722

[22] Filed: May 13, 1986

[30] Foreign Application Priority Data

May 14, 1985 [JP] Japan ..... 60-102057

[51] Int. Cl.[4] ..... F01M 1/16

[52] U.S. Cl. ..... 123/90.34; 123/90.27; 123/90.38; 123/90.44; 123/90.55

[58] Field of Search ..... 123/90.34, 90.27, 90.44, 123/90.38, 90.55

[56] References Cited

U.S. PATENT DOCUMENTS 2,781,750 2/1957 Chayne ..... 123/90.34
3,521,613 7/1970 Celli ..... 123/90.27
4,621,597 11/1986 Kawada ..... 123/90.34

FOREIGN PATENT DOCUMENTS 58-12607 1/1983 Japan ..... 123/90.34
59-226217 12/1984 Japan ..... 123/90.34

*Primary Examiner*—Ronald B. Cox
*Attorney, Agent, or Firm*—Armstrong, Nikaido, Marmelstein & Kubovcik

[57] ABSTRACT

In an oil supply device of a valve operating system mounted in a cylinder head of an internal combustion engine and operable to open or close intake and exhaust valves, there are juxtaposed an oil supply line for supplying a working oil into a hydraulic tappet of the valve operating system and a lubricating oil line for supplying a lubricating oil to those portions of a valve operating cam shaft which are to be lubricated, and orifice means for controlling the flow rate is provided in each the oil lines. The both oil lines are connected in communication to a main oil passageway upstream of the orifice means, the main oil passageway being connected to a source of a hydraulic oil. Air bleed means is provided in the oil supply line and disposed above the lubricating oil line in the central wall of the cylinder head.

11 Claims, 8 Drawing Figures

OIL SUPPLY DEVICE FOR VALVE OPERATING SYSTEM HAVING HYDRAULIC TAPPET IN INTERNAL COMBUSTION ENGINE

BACKGROUND OF THE INVENTION

1. FIELD OF THE INVENTION

The present invention relates to an oil supply device for a valve operating system having a hydraulic tappet in an internal engine.

2. DESCRIPTION OF THE PRIOR ART

A valve operating mechanism is known in the prior art, which has hydraulic tappets provided therein so that the clearances between valve operating cams and intake and exhaust valves need not be adjusted (see Japanese Utility Model Application Laid-open No. 12607/83).

A valve operating mechanism is also known in the prior art, in which an oil supply line for supplying an oil into a hydraulic tappet and a lubricating oil line for supplying an oil to the portions to be lubricated such as bearings or the like of a valve operating cam shaft are provided in a cylinder head of an engine body (see Japanese Patent Application Laid-open No. 226217/84).

In such valve operating systems having hydraulic tappets, there are commonly provided an oil supply line for supplying an oil into a hydraulic tappet and a lubricating oil line for lubricating the portions to be lubricated such as bearings or the like of a valve operating cam shaft. With the conventional such systems, however, various problems are encountered. For example, if the hydraulic pressure within the oil supply line into the hydraulic tappets is excessively increased, a relief valve in such line is opened, resulting in a difficulty of supplying the oil to the bearings of the valve operating cam shaft and further in an inappropriate control in flow rate in the oil supply line into the hydraulic tappets and the lubricating oil line to the bearings of the valve operating cam shaft.

In addition, the incorporation of air in the hydraulic oil supplied into the hydraulic tappets causes the interference with the operation of the hydraulic tappets and hence, it is requisite to provide an air bleed mechanism in the oil supply line into the tappets. On the contrary, even if a little air is incorporated in the lubricating oil being supplied to the portions to be lubricated such as bearings or the like of the valve operating cam shaft in the valve operating system, any interference cannot be made with the lubrication of such portions to be lubricated, but still, for the purpose of providing a more effective lubrication, it is desirable to prevent air from being incorporated into the lubricating oil as well. Further, it is desirable to restrain an increase in weight and size of and a reduction in strength of the cylinder head even if the oil supply line into the hydraulic tappets and the lubricating oil line to the portions to be lubricated are provided in the cylinder head.

Moreover, it is desirable to be able to easily achieve the maintenance when clogging occurs in the oil supply line, the lubricating oil line and the like.

SUMMARY OF THE INVENTION

It is an object of the present invention to provide an oil supply device for a valve operating system having a hydraulic tappet in an internal combustion engine, in which the disadvantages found in the prior art are overcome and which is of a simple construction such that the suppling of an oil into an oil supply line and a lubricating oil line can be ensured to be conducted and the deaerating of the oil in the lubricating oil line in addition to the oil supply line can be also conducted, and further, even if the oil supply line and the lubricating oil line are formed in the cylinder head, the excessively thick portion in the cylinder head is eliminated so that an increase in weight and size of and a reduction in strength of the cylinder head cannot be caused.

To accomplish the above object, according to the first aspect of the present invention there is proveded an oil supply device for a valve operating system having hydraulic tappets in an internal combustion engine, in which a combustion chamber and intake and exhaust ports commnucating with the combustion chamber are formed in a cylinder head of an engine body, and valve operating cams adapted to operate intake and exhaust valves for opening or closing the intake and exhaust ports are mounted on a valve operating cam shaft, and in which hydraulic tappets are incorporated in the interlocking portion between the valve operating cams and the intake and exhaust valves, wherein an oil supply line for supplying a working oil into the hydraulic tappet and a lubricating oil line for supplying a lubricating oil to those portions of the valve operating cam shaft which are to be lubricated are juxtaposed in the cylinder head, and first and second flow rate control orifice means are respectively provided on the ways of the oil supply line and the lubricating oil line, the oil supply line and lubricating oil line being connected in a row to a main oil passageway connected to a source of hydraulic oil upstream of the first and second orifice means.

Further, according to the second aspect of the present invention, there is provided an oil supply device for a valve operating system having hydraulic tappets in an internal combustion engine, in which a combustion chamber and intake and exhaust ports commnucating with the combustion chamber are formed in a cylinder head of an engine body, and valve operating cams for operating intake and exhaust valves for opening or closing the intake and exhaust ports are mounted on a valve operating cam shaft, and in which hydraulic tappets are incorporated in the interlocking portion between said valve operating cams and said intake and exhaust valves, wherein said hydraulic tappets are mounted in the central wall of said cylinder head, and further juxtaposed vertically in two stages in said central wall are an oil supply line for supplying a working oil into said hydraulic tappet, said oil supply line provided with an air bleed means, and a lubricating oil line for supplying a lubricating oil to those portions of said valve operating cam shaft which are to be lubricated, said oil supply line and said lubricating oil line being connected in a row to a main oil passageway connected to a source of a hydraulic oil.

With the above arrangement, it is possible to independently conduct the controlling of the amount of working oil supplied into the hydraulic tappet and of the amount of lubricating oil supplied to the portions to be lubricated such as bearings, thereby insuring that the operation of the hydraulic tappet and the lubrication of the bearings can be accurately conducted with a good efficiency.

Further, it is possible to provide the first orifice means in the oil passage in the vicinity of the hydraulic tappet and to provide the second orifice means in the lubricating oil passage in the vicinity of the portions to be lubricated, thus enabling an appropriate amount of a hydraulic oil to be rapidly supplied into the hydraulic tappet and to the bearings with less time lag even just after the start of the engine, leading to an enhanced response.

Yet further, the air incorporated in the lubricating oil flowing through the lubricating oil line can be discharged outside by utilizing the air bleed mechanism provided in the oil suppling line into the hydraulic tappet, so that the lubricating oil containing less air incorporated therein can be supplied to the portions to be lubricated such as bearing surfaces of the bearings without particularly providing an additional air bleed mechanism in the lubricating oil line to enhance the lubrication performance thereof.

Moreover, the oil supply line and the lubricating line is defined together in the central wall of the cylinder head to eliminate the necessity of particularly forming the cylinder head with a thicker portion for defining both the oil lines. Therefore, the cylinder head may be dispensed with an excessively thick portion formed therein for both the oil lines, and even the provision of both the oil lines cannot cause the increase in weight and size of and the reduction in strength of the cylinder head.

The above and other objects, features and advantages of the invention will become apparent from reading of the following description taken in conjunction with the accompanying drawings.

DESCRIPTION OF THE PREFERRED EMBODIMENTS

The preferred embodiments of the present invention will now be described in more detail with reference to the accompanying drawings.

Figure 6:
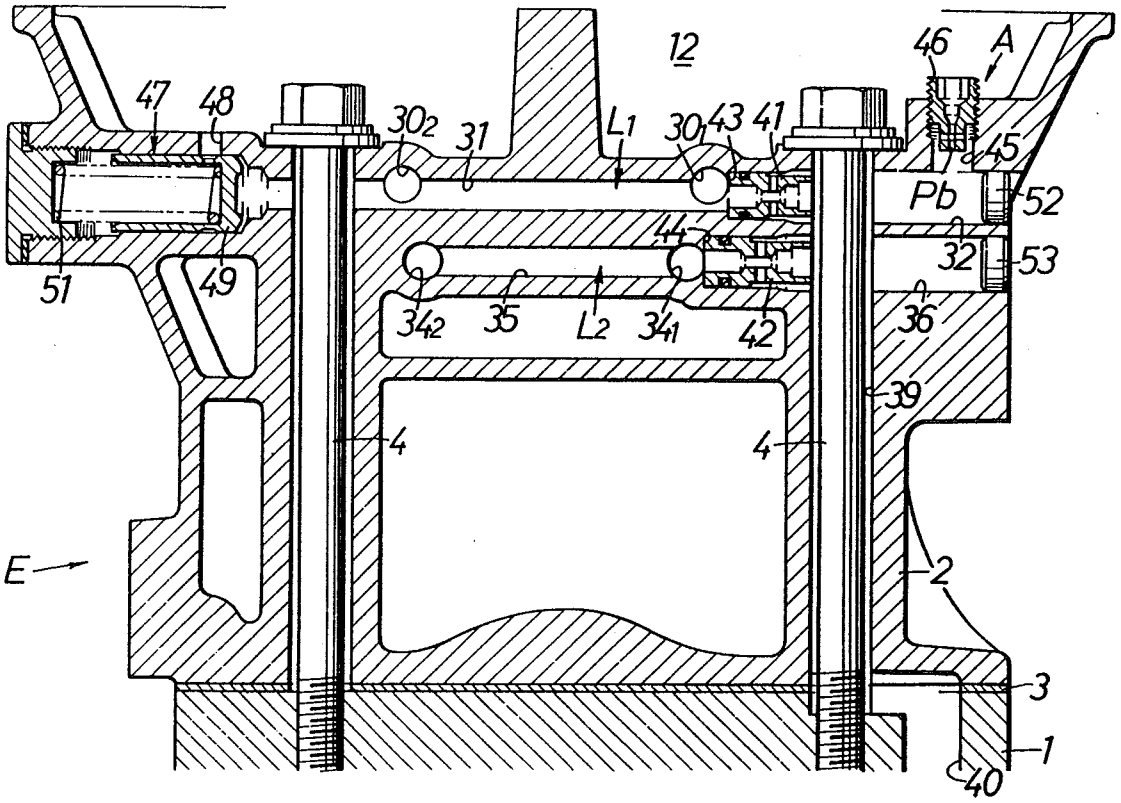
FIG. 6 is a longitudinal sectional view of the cylinder head, taken along the line VI—VI in FIG. 3.
Figure 7:
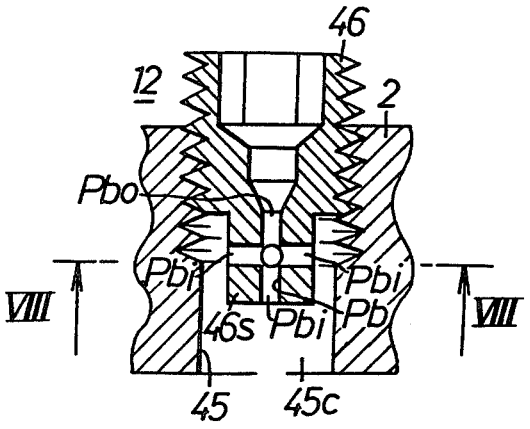
FIG. 7 is an enlarged view of the portion near an air bleed plug shown in FIG. 6.
Figure 8:
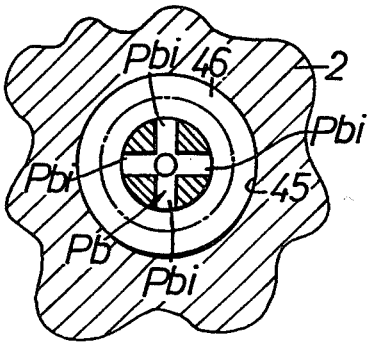
FIG. 8 is a sectional view taken along the line VIII—VIII in FIG. 7.

A body E of a DOHC type four cycle internal combustion engine includes a cylinder block 1 and a cylinder head 2 overlaid thereon with a gasket 3 interposed therebetween, the cylinder block 1 and the cylinder head 2 being integrally connected by head bolts 4 (see FIG. 6).

The cylinder head 2 of the engine body E has a combustion chamber 5, a pair of intake ports 6 and a pair of exhaust ports 7, the intake and exhaust ports being opened into the combution chamber 5 and being adapted to be opened or closed respectively by a pair of intake valves 8 and a pair of exhaust valves 9 which are liftably carried on the cylinder head 2 in a V shape.

The intake and exhaust valves 8 and 9 are operated to open or close with a predetermined timing by valve operating systems 11 each having a hydraulic tappet 10, respectively.

The valve operating system 11 is mounted in a valve operating chamber 12 defined above the cylinder head 2.

The cylinder head 2 has a central wall $2_1$ which extends toward a crankshaft between the intake and exhaust valves 8 and 9 and which has a pair of support holes 13 made therein in a V shape to correspond to the respective combustion chambers 5, the hydraulic tappets 10 being mounted in the support holes 13, respectively. Exhausting cam followers 15 and 16 are each connected at one end thereof to the operating end of each the hydraulic tappet 10, i.e., the spherical upper end of each plunger 14, and are respectively engaged at the other ends thereof with that upper ends of the intake and exhaust valve 8 and 9 which are biased in the valve opening direction by valve springs 21 and 22. A pair of valve operating shafts 17 and 18 have valve operating cams 19 and 20 which bear against slipper surfaces defined on the middle and upper surfaces of the intake and exhaust cam followers 15 and 16, respectively, so that the rotation of the valve operating cams 19 and 20 causes the intake and exhaust valves 8 and 9 to be opened or closed with a predetermined timing in cooperation with the valve springs 21 and 22. The pair of intake and exhaust valve operating cam shafts 17 and 18 are rotatably journaled respectively by bearings 27 and 28 comprised of bearing halves 23 and 24 on the cylinder head 2 and bearing caps 25 and 26 secured thereon.

Figure 2:
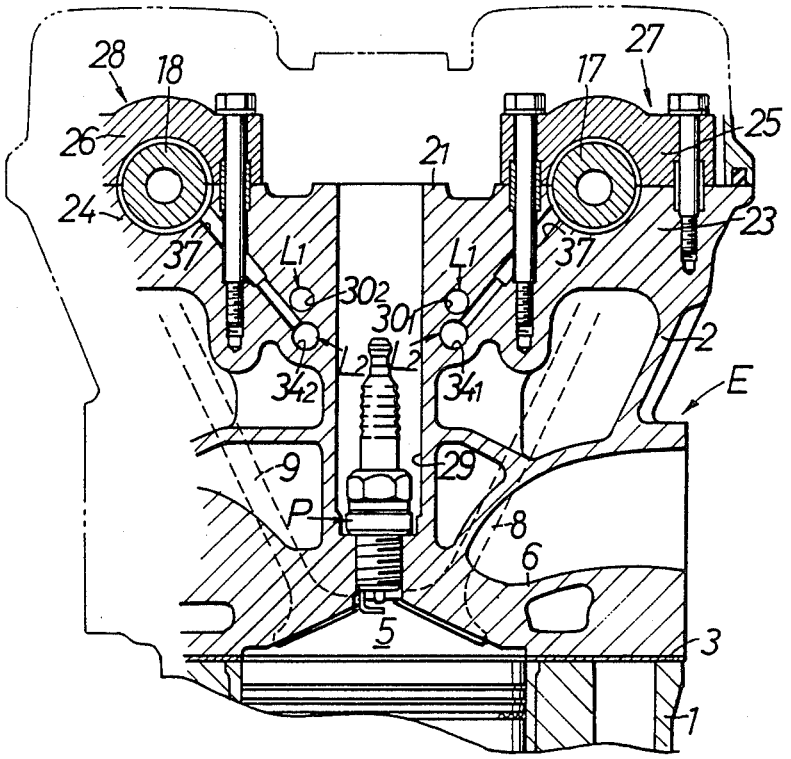
FIG. 2 is a vertical section view of a bearing portion of a valve operating cam shaft in the engine body.
Figure 3:
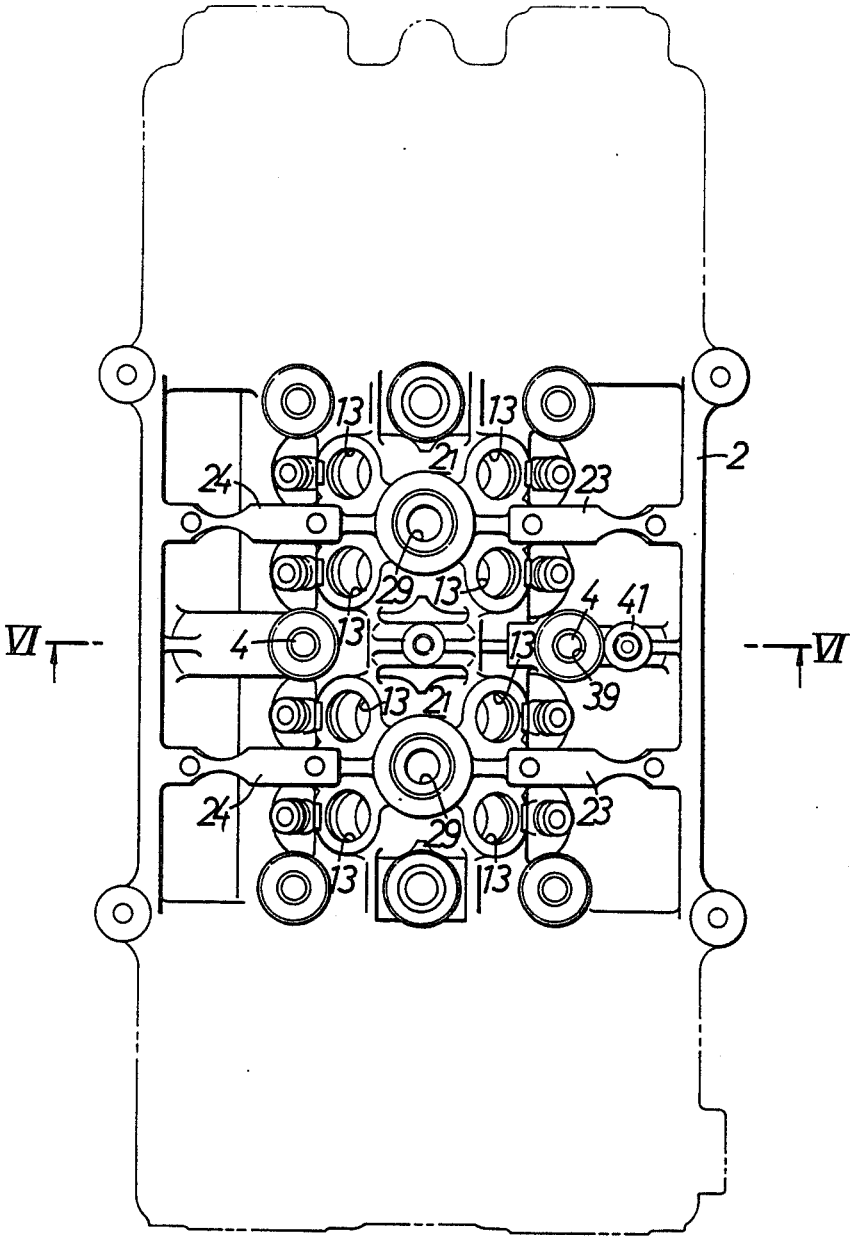
FIG. 3 is a partially omitted plan view of a cylinder head, taken along the line III—III in FIG. 1.

A substantially vertical plug bore 29 is perforated in the central wall $2_1$ of the cylinder head 2, as shown in FIG. 2, and an ignition plug P is inserted in the plug bore 29 and mounted in the combustion chamber 5.

On the opposite sides of the plug bore 29, oil supply lines L1 for suppling a hydraulic oil into a plurality of hydraulic tappets 10 and lubricating oil lines L2 for supplying an oil to those portions of the valve operating mechanism 11 which are to be lubricated such as the bearings 27 and 28 of the valve operating cam shafts 17 and 18 are substantially horizontally juxtaposed in two stages in the central wall $2_1$ at a distance vertically spaced apart one from the other.

Figure 4:
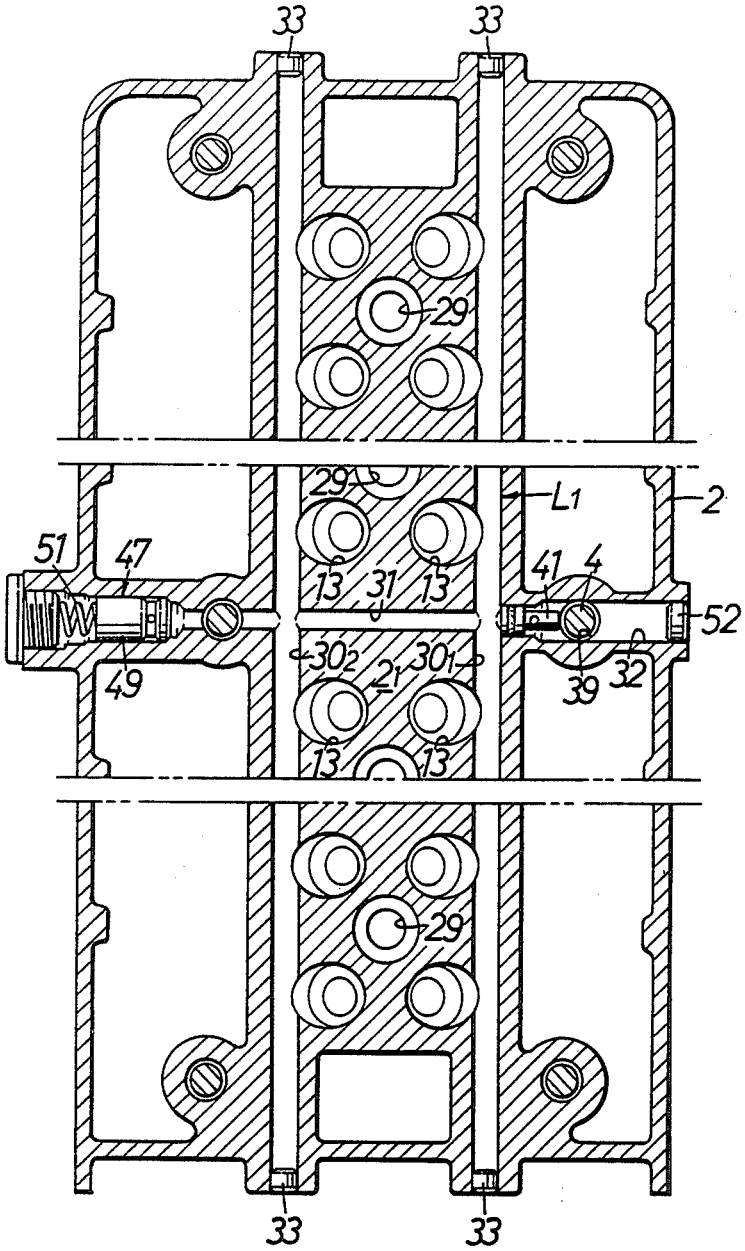
FIG. 4 is a partially omitted cross sectional view of the cylinder head, taken along the line V—V in FIG. 1.
Figure 5:
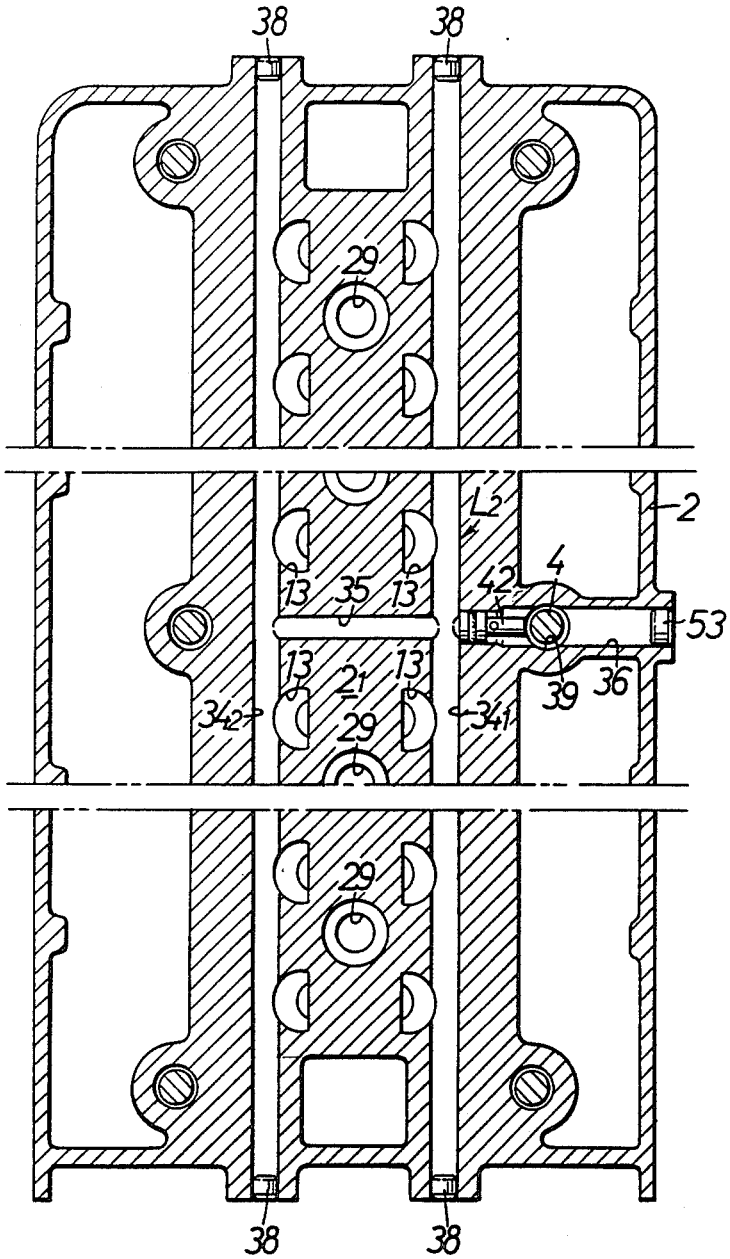
FIG. 5 is a partially omitted cross sectional view of the cylinder head, taken along the line IV—IV in FIG. 1.

As shown in FIGS. 4 and 5, any of the oil supply lines L1 and the lubricating oil lines L2 is defined substantially in an H shape in plane.

As shown in FIG. 4, the oil supply line L1 is constituted of a pair of longitudinal oil passages $30_1$ and $30_2$ extending parallel to each other in the lengthwise direction of the cylinder head 2, a transverse oil passage 31 extending across the central portions between the longitudinal oil passages $30_1$ and $30_2$ to permit the communication between the longitudinal oil passages, and an inlet oil passage 32 communicating with one longitudinal oil passage $30_1$. The pair of longitudinal oil passages $30_1$ and $30_2$ extend respectively to communicate with the plurality of support holes 13 at their side walls. The opposite ends of each the longitudianl oil passages $30_1$ and $30_2$ are opened in the outside surfaces of the cylinder head 2, each of the opened ends being closed by a blind plug 33.

Figure 1:
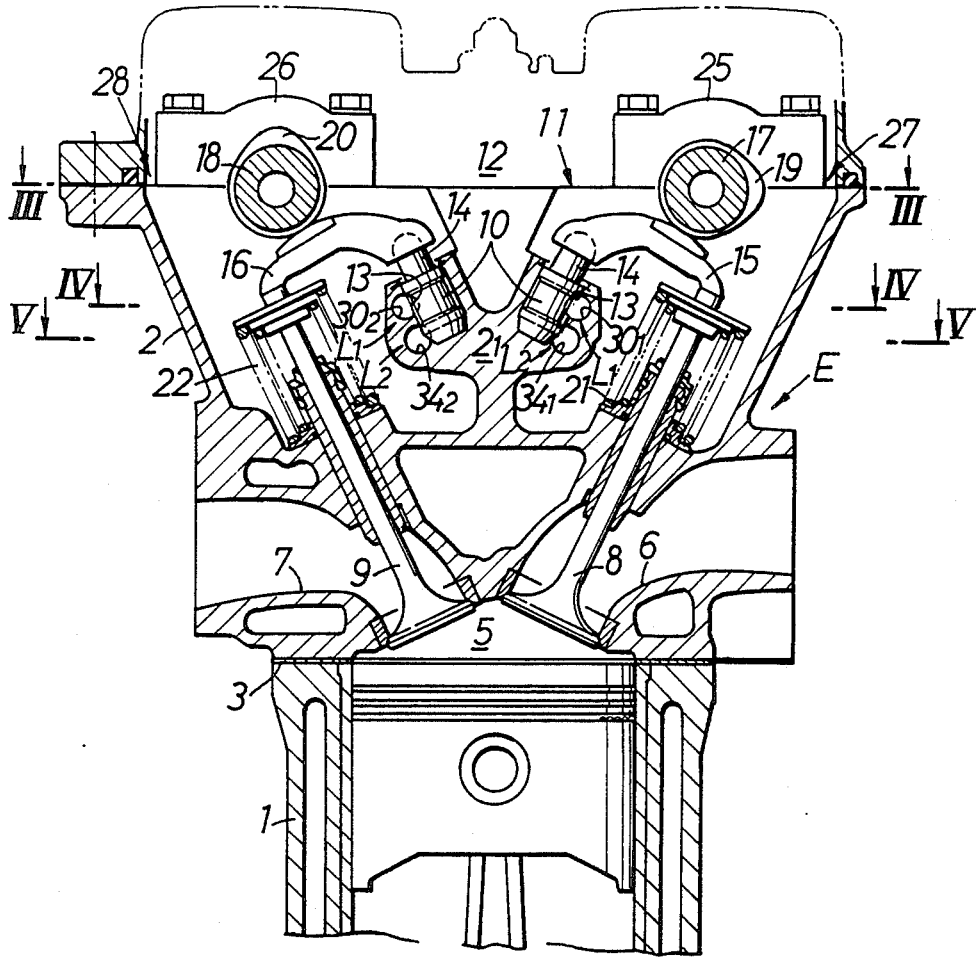
FIG. 1 is a vertical sectional view of a valve operating mechanism portion in an engine body provided with a device according to one embodiment of the present invention.

The lubricating oil line L2 is provided below the oil supply line L1 and as shown in FIG. 5, it is constituted of a pair of longitudinal oil passages $34_1$ and $34_2$ extending in parallel to each other in the lengthwise direction of the cylinder head 2, a transverse oil passage 35 extending across the central portions between the longitudinal oil passages $34_1$ and $34_2$ to permit the communication between the longitudinal oil passages, and an inlet oil passage 36 communicating with one longitudinal oil passage $34_1$. The pair of longitudinal oil passages $34_1$ and $34_2$ are connected through angularly upwardly extending diverged oil passages 37 (FIG. 2) to the bearing surfaces of the plurality of bearings 27 and 28 of the valve cam shafts 17 and 18. It should be noted that the lubricating oil in the longitudinal oil passages $34_1$ and $34_2$ can also be supplied to the other portions of the valve operating mechanism, for example, the contact surfaces between the cam followers 15 and 16 and the valve operating cams 19 and 20. The opposite ends of each the longitudinal oil passages $34_1$ and $34_2$ are opened in the outside surfaces of the cylinder head 2, each of the opened ends being closed by a blind plug 38. As seen from FIG. 1, one sides of the longitudinal oil passages $34_1$ are respectively in communication with the bottoms of the support holes 13 and utilized as vent passages for air which is confined between the hydraulic tappets 10 in mounting these tappets in the support holes 13.

The oil inlet passage 32 of the oil supply line L1 and the oil inlet passage 36 of the lubricating oil line L2 are connected in a row to a main oil passageway 39. Consequently, the oil inlet passage 32 of the oil supply line L1 is connected via the main oil passageway 39 with the oil inlet passage 36 of the lubricating oil line L2. The main oil passageway 39 extends in the cylinder head 2 in the vertical direction thereof to also serves as a through hole for the head bolt 4 and is connected via an oil passage 40 made in the cylinder block 1 to a hydraulic pump which is not shown.

First orifice means 41 is inserted in the oil inlet passage 32 of the oil supply line L1 in the vicinity of the hydraulic tappet 10, while second orifice means 42 is inserted in the oil inlet passage 36 of the lubricating oil line L2 in the vicinity of the diverged oil passages 37, i.e., the bearings 27 and 28. The first and second orifice means 41 and 42 are positioned with one end surfaces thereof engaging stepped portions 43 and 44 formed in the oil inlet passage 32 and 36 and with the other ends thereof faced to the head bolt 4 passed through the the main oil passageway 39. Accordingly, the head bolt 4 connecting the cylinder head 2 onto the cylinder block also serves to restrict the positions of the orifice means 41 and 42. An air bleeder A is provided in the inlet of the oil supply line L1. More specifically, an air bleed passsage 45 epened into the valve operating chamber 12 is defined in the vicinity of the uppermost portion of the oil passage 32 upstream of the first orifice means 41, and an air bleed plug 46 is threadedly connected to the opened end of the air bleed passage 45 to define a deaerating chamber **45*c* below the plug 46. The air bleed plug 46 has a smaller diameter portion 46*s* at its lower portion and has three passages cut through the smaller diameter portion in a multi-level crossing manner to provide a breather bore Pb which has, at the left and right ends, the fore and rear ends and the lower end thereof, a plurality of inlets Pb1 opened into the deaerating chamber 45*c*, and at the upper end thereof, an outlet Pbo opened into the valve operating chamber 12. Therefore, the air incorporated in the hydraulic oil which has entered the oil inlet passage 32 through the main oil passageway 39 is removed out of the hydraulic oil in the deaerating chamber 45*c* and then discharged from the plurality of inlets Pbi via the breather bore Pb into the valve operating chamber 12. In this case, because the breather bore Pb has the plurality of inlets Pbi opened in the deaerating chamber 45*c***, such venting of air may be ensured to be conducted without hindrance even though the clogging of dust in some of the inlets Pbi occurs.

As shown in FIGS. 4 and 6, a relief valve 47 is mounted in the other oil passage $30_2$ of the oil supply line L1. The relief valve 47 is comprised of a piston 49 for opening or closing a relief bore 48, and a valve spring 51 for biasing the piston 49 to close the relief bore 48.

Description will now be made of the operation of this embodiment of the present invention.

Now, if the operation of the engine causes the pair of valve operating shafts 17 an 18 to be rotated, the cam followers 15 and 16 are vertically swung as a fulcrum of the connected points with the hydraulic tappets 10 by the rotation of the valve operating cams 19 and 20 and the resilient force of the valve springs 21 and 22, thereby causing the intake and exhaust valves 8 and 9 to vertically slide, so that the intake and exhaust ports 6 and 7 are opened or closed with the predermined timing.

A portion of a hydraulic oil from the hydraulic pump driven by the operation of the engine flows through the oil passage in the block into the main oil passageway 39. The hydraulic oil in the main oil passageway 39 is directed through the oil inlet passages 32 and 36 into both the oil supply line L1 and the lubricating oil line L2.

The hydraulic oil which has entered the oil supply line L1 is controlled in flow rate by the first orifice 41 and then, it is passed into the one longitudinal oil passage $30_1$ and also into the other longitudinal oil passage $30_2$ via the transverse oil passage 31 and supplied into each hydraulic tappet 10. It is noted that the air incorporated in the hydraulic oil flowing into the oil supply line L1 is discharged through the air bleed plug 46 into the valve operating chamber 12 and thus, the deaerated hydraulic oil is supplied into the hydraulic tappets 10. Each of the hydraulic tappets 10 is of a conventionally known construction and is operated upon the reception of the hydraulic oil, so that the plungers 14 on the upper ends of the hydraulic tappets 10 are respectively urged against the base ends of the cam followers 15 and 16 to provide the above-described smooth valve-operation.

On the other hand, the hydraulic oil which has entered the lubricating oil line L2 is passed through the second orifice 42 to become controlled in flow rate and then, it is passed into the pair of longitudinal oil passages $34_1$ and $34_2$ and the transverse oil passage 35 and supplied to the bearing surfaces of the plurality of bearings 27 and 28 of the valve operating shafts 17 and 18. It is to be noted that the air incorporated in the hydraulic oil intended to enter the lubricating oil line L2 may be passed from the vertically extending main oil passageway 39 via the oil inlet passage 32 of the oil supply line L1 and discharged through the air bleed plug 46 into the valve operating chamber 12, so that the lubricating oil containing less air incorporated therein is supplied to the bearing surfaces of the bearings 27 and 28.

In addition, it should be understood that the oil supply lines L1 and the lubricating oil lines L2 are provided together in that central wall $2_1$ of the cylinder head 2 which is located between the intake and exhaust valves 8 and 9, so that even the provision of these oil valves L1 and L2 may not cause an increased in thickness at the other portion of the cylinder head 2.

The amounts of hydraulic oil supplied into the hydraulic tappets 10 and to the bearings 27 and 28 of the valve operating cam shafts 17 and 18 are independently controlled at an appropriate level by the first and second orifices 41 and 42, ensuring that the operation of the hydraulic tappets 10 and the lubrication of the bearings 27 and 28 are efficiently conducted. Even if the hydraulic pressure within the oil feed line L1 is excessively increased for some reason to open the relief valve 47, thereby causing the pressure within the oil supply line L1 to be reduced, the lubricating oil may be supplied to the bearings 27 and 28 without any hindrance.

In addition, since the first and second oil supply lines L1 and L2 are provided in the cylinder head 2 and the first and second orifice means 41 and 42 are disposed in proximity of the hydraulic tappets 10 and the bearings 27 and 28 which are the portions of the valve operating mechanism 11 to be lubricated, the hydraulic oil from the hydraulic pump is allowed to rapidly flow to the first and second orifices 41 and 42 without resistance at the start of the engine and then, the oils are passed through the first and second orifices 41 and 42 so that the flow rates thereof are controlled, and thereafter, the oils passed through the orifices are supplied respectively to the portions which are to be lubricated and which are located near such orifices. This results in a reduction in delay of time from the start of the engine to the moment at which the hydraulic oil from the pump reaches the portions of the valve operating system 11 to be lubricated, leading to the enhanced responsive operation of the portions to be libricated.

When clogging or the like has occured in the first and second orifices 41 and 42 and the maintenance of them is to be carried out, the blind plugs 52 and 53 detachably screwed into the opened ends of the oil inlet passages 32 and 36 may be unscrewed and the one righthand head bolt 4 shown in FIG. 6 may be removed, whereby the orifice means 41 and 42 can be removed outside from the oil feed passages 30 and 32. Thus, the maintenance of the first and second orifices 41 and 42 can be conducted without removing the cylinder head 2 from the cylinder block 1.

Alternatively, the main oil passageway 39 may be provided independently of the head bolt 4, whereby the orifices means 41 and 42 and the blind plugs 52 and 53 can be formed in the same member.

What is claimed is:

1. An oil supply device for a valve operating system having hydraulic tappets in an internal combustion engine, in which a combustion chamber and intake and exhaust ports communicating with the combustion chamber are formed in a cylinder head of an engine body, and valve operating cams for operating intake and exhaust valves for opening and closing the intake and exhaust ports are mounted on a valve operating cam shaft, and in which hydraulic tappets are incorporated in the interlocking portion between said valve operating cams and said intake and exhaust valves, wherein an oil supply line for supplying a working oil into said hydraulic tappet and a lubricating oil line for supplying lubricating oil to those portions of said valve operating cam shaft which are to be lubricated are juxtaposed in said cylinder head, and first and second flow rate control orifice means are respectively provided on the ways of said oil supply line and said lubricating oil line, said oil supply line and lubricating oil line being connected in a row to a main oil passageway connected to a source of a hydraulic oil upstream of said first and second orifice means, said cylinder head being securely connected on a cylinder block of said engine body by means of a head bolt, and said oil supply line has a oil supply passage communicating with said main oil passageway, and wherein said first orifice means is disposed with one end thereof engaged with a locking stepped portion formed in said oil supply passage and with the other end surface thereof faced to the outer surface of said head bolt.

2. An oil supply device for a valve operating system having hydraulic tappets in an internal combustion engine, in which a combustion chamber and intake and exhaust ports communicating with the combustion chamber are formed in a cylinder head of an engine body, and valve operating cams for operating intake and exhaust valves for opening and closing the intake and exhaust ports are mounted on a valve operating cam shaft, and in which hydraulic tappets are incorporated in the interlocking portion between said valve operating cams and said intake and exhaust valves, wherein said hydraulic tappets are mounted in the central wall of said cylinder head, and an oil supply line for supplying working oil into said hydraulic tappet and a lubricating oil line are vertically juxtaposed in said central wall, said oil supply line being provided with an air bleed means in the vicinity of the upstream end of the uppermost portion of said oil supply line, said air bleeder means including a deaerating chamber and a air bleed plug for permitting the communication of said deaerating chamber with the valve operating chamber within said cylinder head, said air bleed plug having an air bleed bore made therein, and said air bleed bore including a plurality of inlets opened into said deaerating chamber and an outlet opened into said valve operating chamber, said lubricating oil line supplying a lubricating oil to those portions of said valve operating cam shaft which are to be lubricated, said oil supply line and said lubricating oil line being connected in a row to a main oil passageway connected to a source of hydraulic oil.

3. An oil supply device for a valve operating system having hydraulic tappets in an internal combustion engine, in which a combustion chamber and intake and exhaust ports communicating with the combustion chamber are formed in a cylinder head of an engine body, and valve operating cams for operating intake and exhaust valves for opening and closing the intake and exhaust ports are mounted on a valve operating cam shaft, and in which hydraulic tappets are incorporated in the interlocking portion between said valve operating cams and said intake and exhaust valves, wherein said hydraulic tappets are mounted in the central wall of said cylinder head, and an oil supply line for supplying working oil into said hydraulic tappet and a lubricating oil line are vertically juxtaposed in said central wall, said oil supply line being provided with an air bleed means, and said lubricating oil line supplying a lubricating oil to those portions of said valve operating cam shaft which are to be lubricated, said oil supply line and said lubricating oil line being connected in a row to a main oil passageway connected to a source of a hydraulic oil, said cylinder head being securely connected on a cylinder block of said engine body by means of a head bolt, and said oil supply line having a oil supply passage communicating with said main oil passageway, and wherein said first orifice means is disposed with one end thereof engaged with a locking stepped portion formed in said oil supply passage and with the other end surface thereof faced to the outer surface of said head bolt.

4. An oil supply system according to claim 1, wherein said cylinder head is securely connected on a cylinder block of said engine body by means of a head bolt, and said first orifice means is disposed with one end thereof engaged with a locking stepped portion formed in said oil supply passage and with the other end surface thereof faced to the outer surface of said head bolt.

5. An oil supply system according to claim 1, wherein a through hole made in said cylinder head to receive said head bolt also serves as said main oil passageway.

6. An oil supply system according to claim 5, wherein an air bleed means is provided in the vicinity of the uppermost portion of said oil supply passage, and said lubricating oil line is provided below said oil supply line, said main oil passageway extending vertically and said lubricating oil line being connected in communication to said air bleed means through said main oil passageway.

7. An oil supply device according to claim 6, wherein said air bleeder means includes a deaerating chamber and an air bleed plug for permiting the communication of said deaerating chamber with the valve operating chamber within said cylinder head, said air bleed plug having an air bleed bore made therein, and said air bleed bore including a plurality of inlets opened into said deaerating chamber and an outlet opened into said valve operating chamber.

8. An oil supply device according to claim 1, wherein said hydraulic tappet is formed in said cylinder head and mounted in a support hole communicated with said oil supply line, and said lubricating oil line communicates with the bottom of said support hole and also serves as an air venting passage in mounting said hydraulic tappet in said support hole.

9. An oil supply device according to claim 2, wherein said oil supply line has an oil supply passage opened into the outside surface of said cylinder head, and said first orifice means is provided in said oil supply passage, the opened end of the oil supply passage being closed by a detachable blind plug.

10. An oil supply system according to claim 3, wherein said said oil supply line has an oil supply passage opened into the outside surface of said cylinder head, and said first orifice means is provided in said oil supply passage, the opened end of the oil supply passage being closed by a detachable blind plug, said first orifice means being disposed with one end thereof engaged with a locking stepped portion formed in said oil supply passage and with the other end surface thereof faced to the outer surface of said head bolt.

11. An oil supply device according to claim 2, wherein said hydraulic tappet is formed in the central portion of said cylinder head and mounted in a support hole communicated with said oil supply line, and said lubricating oil line commnucates with the bottom of said support hole and also serves as an air venting passage in mounting said hydraulic tappet in said support hole.

* * * * *